US005881570A

United States Patent [19]

Drnevich et al.

[11] Patent Number: 5,881,570

[45] Date of Patent: Mar. 16, 1999

[54] CRYOGENIC RECTIFICATION APPARATUS FOR PRODUCING HIGH PURITY OXYGEN OR LOW PURITY OXYGEN

[75] Inventors: Raymond Francis Drnevich, Clarence Center; Ravindra Fulchand Pahade, Getzville; Minish Mahendra Shah, Amherst, all of N.Y.

[73] Assignee: Praxair Technology, Inc., Danbury, Conn.

[21] Appl. No.: 55,683

[22] Filed: Apr. 6, 1998

[51] Int. Cl.[6] ..... F25J 3/04

[52] U.S. Cl. ..... 62/646; 62/900

[58] Field of Search ..... 62/643, 644, 646, 62/648, 900

[56] References Cited

U.S. PATENT DOCUMENTS 4,254,629 3/1981 Olszewski .
5,315,833 5/1994 Ha et al. .
5,396,773 3/1995 Ha et al. .
5,463,871 11/1995 Cheung .
5,546,767 8/1996 Dray et al. ..... 62/646
5,582,036 12/1996 Drnvich et al. ..... 62/656
5,628,207 5/1997 Howard et al. ..... 62/646
5,644,933 7/1997 Rathbone ..... 62/900 X
5,669,236 9/1997 Billingham et al. ..... 62/900 X
5,682,766 11/1997 Bonaquist et al. ..... 62/646

*Primary Examiner*—Christopher B. Kilner
*Attorney, Agent, or Firm*—Stanley Ktorides

[57] ABSTRACT

A cryogenic rectification plant comprising a double column and a side column having a bottom reboiler wherein feed air is passed into the double column by way of the bottom reboiler and an auxiliary compressor is connected in parallel with the feed air line.

8 Claims, 3 Drawing Sheets

CRYOGENIC RECTIFICATION APPARATUS FOR PRODUCING HIGH PURITY OXYGEN OR LOW PURITY OXYGEN

TECHNICAL FIELD

This invention relates generally to cryogenic rectification of air and, more particularly, to cryogenic rectification of air for the production of oxygen.

BACKGROUND ART

Many large consumers of oxygen, such as integrated steel mills, require both low purity oxygen and high purity oxygen. Because of the large volumes of oxygen required, entire cryogenic air separation plants are dedicated to providing the oxygen for such consumer. Typically two cryogenic air separation plants are employed, one for producing the high purity oxygen and the other for producing the low purity oxygen.

Both the high purity oxygen plant and the low purity oxygen plant must have a back up system in order to ensure that the flow of oxygen will continue to the steel mill in the event the oxygen plant must shut down. The back up system for the low purity oxygen plant is the high purity oxygen plant since a use that requires low purity oxygen can also operate using high purity oxygen without any loss of quality. However the high purity oxygen plant cannot be backed up by the low purity oxygen plant because a use that requires high purity oxygen cannot operate effectively with low purity oxygen. Accordingly, the back up system for the high purity oxygen plant is a tank filled with high purity liquid oxygen, which is vaporized and used if the need arises. This back up system, while necessary, is expensive to operate. It would be very desirable to have a low purity oxygen plant which, if the need arises, can quickly switch to producing, and can efficiently produce, high purity oxygen, so that such plant can serve as the back up to the high purity oxygen plant and thus eliminate the need for the expensive liquid oxygen reserve tank.

It is therefore an object of this invention to provide a cryogenic air separation plant which can produce efficiently either high purity oxygen or low purity oxygen and can quickly switch from producing one to the other.

SUMMARY OF THE INVENTION

The above and other objects, which will become apparent to one skilled in the art upon a reading of this disclosure, are attained by the present invention which is:

A cryogenic rectification apparatus for producing high purity oxygen or low purity oxygen comprising:

(A) a double column comprising a high pressure column and a low pressure column;

(B) a side column having a bottom reboiler;

(C) a primary heat exchanger, and a feed line for passing feed air to the primary heat exchanger;

(D) an auxiliary compressor having an input and an output, means for passing feed air from the feed line to the auxiliary compressor input, and means for passing feed air from the auxiliary compressor output to the feed line;

(E) means for passing feed air from the primary heat exchanger to the bottom reboiler, and means for passing feed air from the bottom reboiler to the high pressure column;

(F) means for passing fluid from the low pressure column to the side column;

(G) means for passing product from the side column to the primary heat exchanger; and (H) means for recovering product high purity or low purity oxygen from the primary heat exchanger.

As used herein, the term "feed air" means a mixture comprising primarily oxygen and nitrogen , such as ambient air.

As used herein, the term "column" means a distillation or fractionation column or zone, i.e. a contacting column or zone, wherein liquid and vapor phases are countercurrently contacted to effect separation of a fluid mixture, as, for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process.

The term "double column", is used to mean a higher pressure column having its upper end in heat exchange relation with the lower end of a lower pressure column. A further discussion of double columns appears in Ruheman "The Separation of Cases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the terms "upper portion" and "lower portion" mean those sections of a column respectively above and below the mid point of the column.

As used herein, the terms "turboexpansion" and "turboexpander" mean respectfully method and apparatus for the flow of high pressure gas through a turbine to reduce the pressure and the temperature of the gas thereby generating refrigeration.

As used herein, the term "compressor" means a device for increasing the pressure of a gas.

As used herein, the term "bottom reboiler" means a heat exchange device that generates column upflow vapor from column liquid.

As used herein, the term "high purity oxygen" means a fluid having an oxygen concentration of at least 99.6 mole percent.

As used herein, the term "low purity oxygen" means a fluid having an oxygen concentration less than 99.6 mole percent.

DETAILED DESCRIPTION

Figure 1:
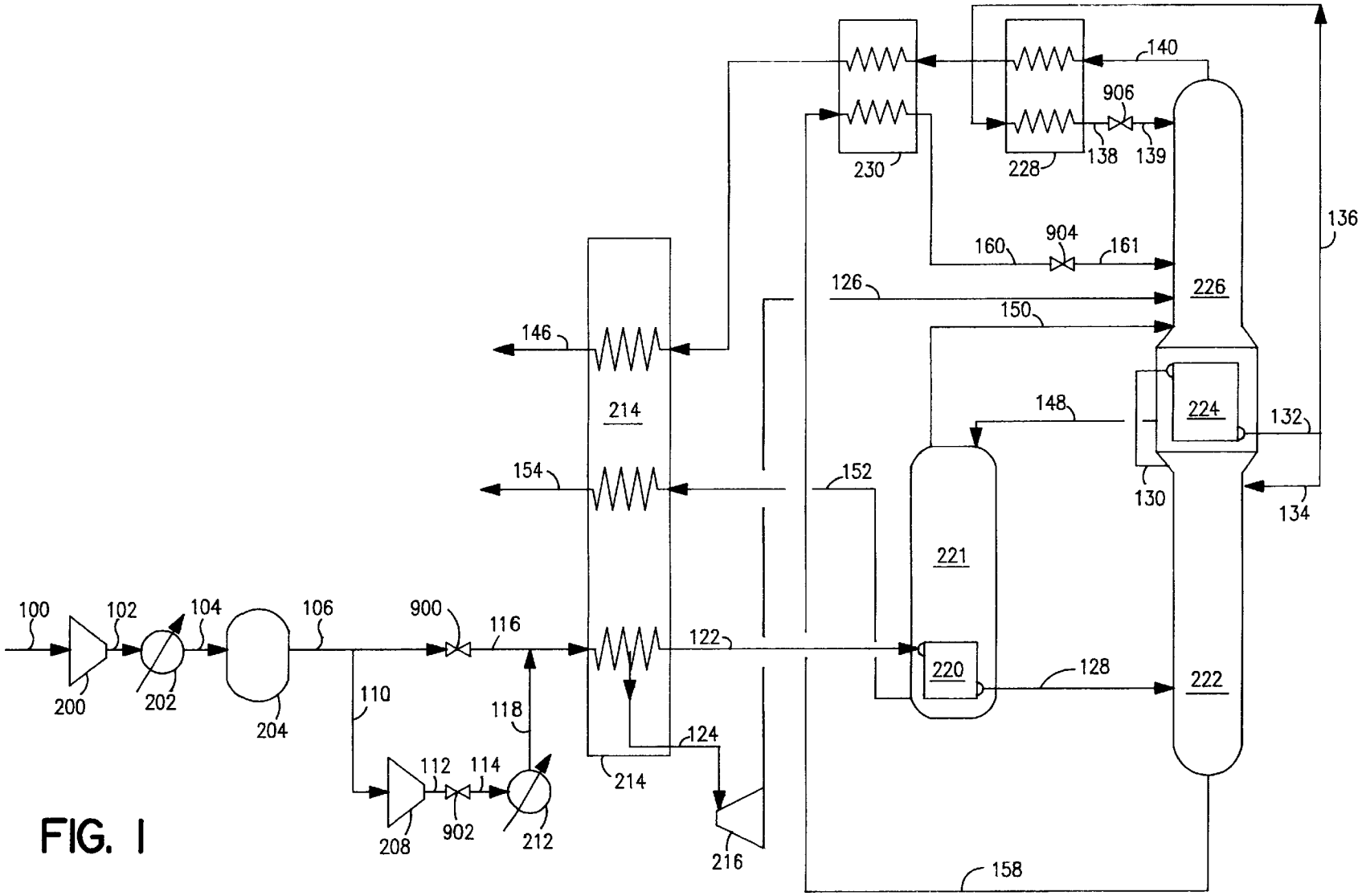
FIG. 1 is a schematic representation of one preferred embodiment of the cryogenic rectification apparatus of this invention.

The invention will be described in detail with reference to the Drawings. Referring now to FIG. 1, feed air 100 is compressed to a pressure generally within the range of from 40 to 70 pounds per square inch absolute (psia) by passage through base load air compressor 200, and resulting pressurized feed air 102 is cooled of the heat of compression by passage through cooler 202. The feed air is then passed in stream 104 through prepurifier 204 wherein it is cleaned of high boiling impurities such as carbon dioxide, water vapor and hydrocarbons to produce prepurified feed air 106 which is passed in a feed line to primary heat exchanger 214.

When the cryogenic rectification plant is operating to produce low purity oxygen, valve 900 is open and valve 902 is closed, and the feed air is passed to primary heat exchanger 214 through the feed line comprising conduit 106, valve 900 and conduit 116.

Auxiliary compressor 208 is connected in parallel to the feed line. The input of auxiliary compressor 208 communicates with conduit 106 of the feed line upstream of valve 900 by means of conduit 110. The output of auxiliary compressor 208 communicates with conduit 116 of the feed line downstream of valve 900 by means of conduit 112, valve 902, conduit 114, cooler 212 and conduit 118. When the production of high purity oxygen is desired, valve 900 is closed, valve 902 is opened and feed air passes from conduit 106 through conduit 110 to auxiliary compressor 208 wherein it is compressed to a pressure generally within the range of from 70 to 100 psia. Resulting feed air in stream 112 is passed through valve 902 and then in stream 114 to cooler 212 wherein it is cooled of the heat of compression, and then in stream 118 back to the feed line and then to primary heat exchanger 214.

The feed air is cooled by passage through primary heat exchanger 214 by indirect heat exchange with return streams and then passed in stream 122 from primary heat exchanger 214 into bottom reboiler 220 of side column 221 wherein it is at least partially condensed by indirect heat exchange with reboiling side column bottom liquid. The resulting feed air is then passed in stream or conduit 128 from bottom reboiler 220 into the lower portion of high pressure column 222. In the embodiment of the invention illustrated in FIG. 1, a portion of the feed air is withdrawn after partial traverse of primary heat exchanger 214 and passed in stream 124 to turboexpander 216 wherein it is turboexpanded to generate refrigeration. The resulting turboexpanded feed air is passed in stream 126 from turboexpander 216 into low pressure column 226.

High pressure column 222 is operating at a pressure generally within the range of from 38 to 98 psia. Within high pressure column 222 the feed air is separated by cryogenic rectification into nitrogen-enriched vapor and oxygen-enriched liquid. The oxygen-enriched liquid is withdrawn from the lower portion of high pressure column 222 in stream 158, subcooled by passage through subcooler 230, and then passed in stream 160 through valve 904 and in stream 161 into low pressure column 226. Nitrogen-enriched vapor is passed in stream 130 from the upper portion of high pressure column 222 into main condenser 224 wherein it is condensed by indirect heat exchange with reboiling column 226 bottom liquid. The resulting nitrogen-enriched liquid is withdrawn from main condenser 224 in stream 132. A portion of stream 132 is passed back to high pressure column 222 as reflux in stream 134. Another portion of stream 132 in stream 136 is subcooled by passage through subcooler 228 and resulting subcooled stream 138 is passed through valve 906 and in stream 139 into the upper portion of low pressure column 226 as reflux.

Within low pressure column 226 the various feeds are separated by cryogenic rectification into nitrogen-richer vapor and oxygen-richer fluid. The nitrogen-richer vapor is withdrawn from the upper portion of low pressure column 226 in stream 140, warmed by passage through subcoolers 228 and 230 and primary heat exchanger 214, and removed from the system in stream 146. If desired, part or all of stream 146 may be recovered as product nitrogen.

Oxygen-richer fluid is passed as liquid in stream 148 from the lower portion of low pressure column 226 into the upper portion of side column 221, which is operating at a pressure generally within the range of from 15 to 25 psia, and then passed down side column 221 against upflowing vapor, generated by the reboiling of side column bottom liquid against condensing feed air in bottom reboiler 220, to form oxygen product and residual vapor. The residual vapor is passed from the upper portion of side column 221 in stream 150 into low pressure column 226. The oxygen product, which may be either high purity oxygen or low purity oxygen depending upon whether auxiliary compressor 208 is on line, is passed from the lower portion of side column 221 to primary heat exchanger 214 wherein it is warmed and from which it is subsequently recovered. In the embodiment of the invention illustrated in FIG. 1, the product oxygen is withdrawn as a gas from side column 221, above the level of bottom reboiler 220, in stream 152, warmed by passage through primary heat exchanger 214 and recovered in stream 154.

Figure 2:
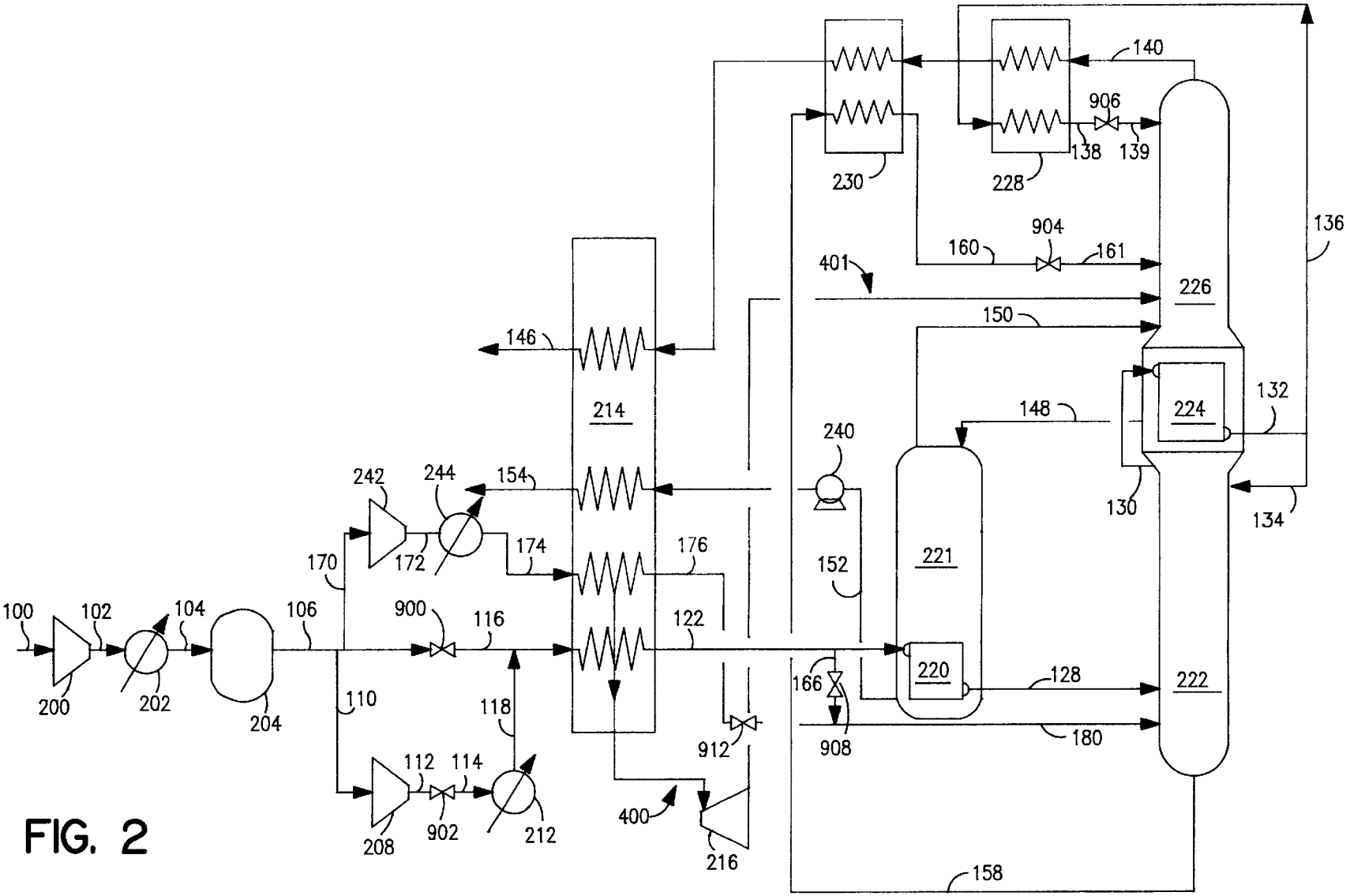
FIG. 2 is a schematic representation of another preferred embodiment of the cryogenic rectification apparatus of this invention.
Figure 3:
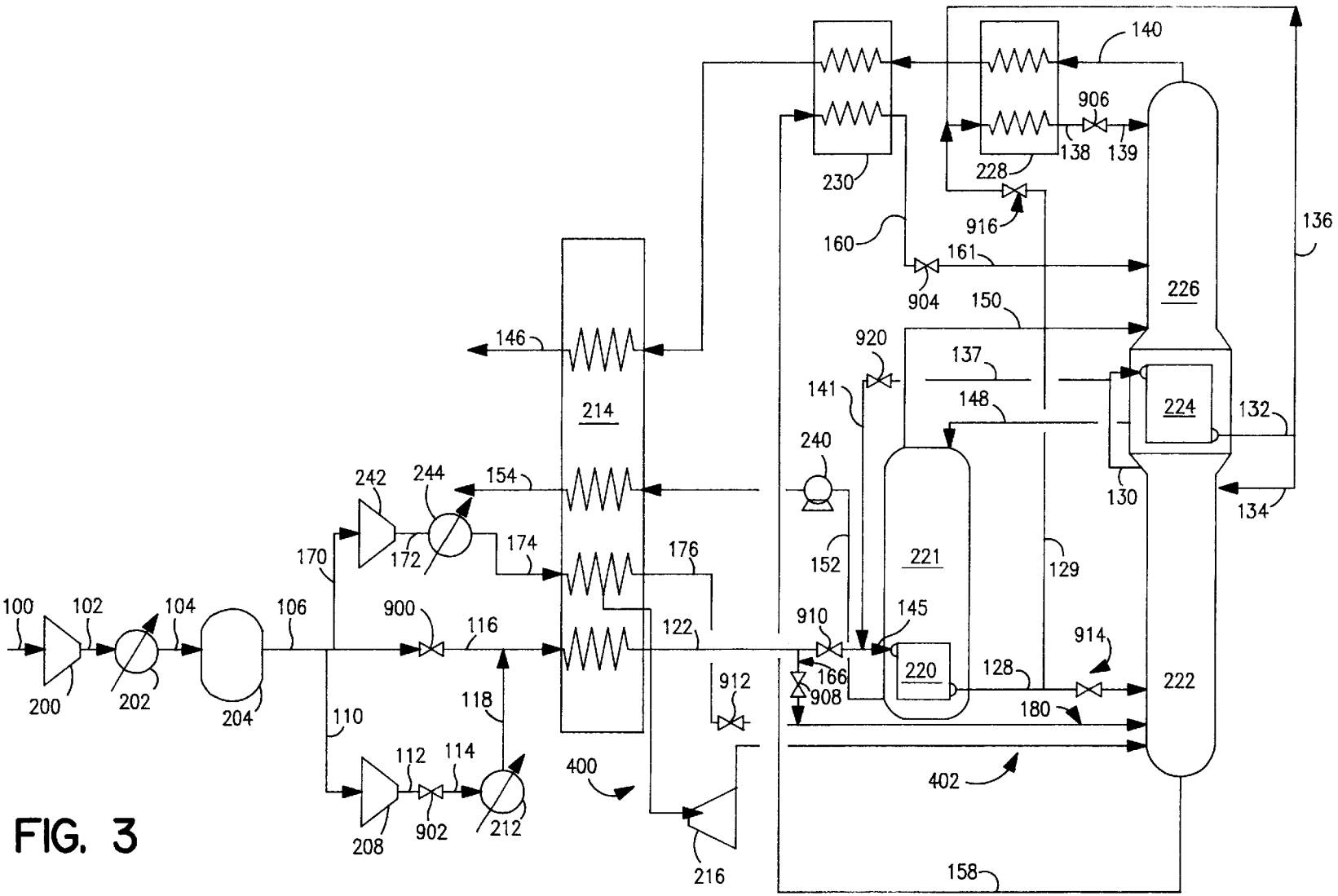
FIG. 3 is a schematic representation of yet another preferred embodiment of the cryogenic rectification apparatus of this invention.

FIGS. 2 and 3 illustrate other preferred embodiments of the invention. The numerals in the Drawings correspond for the common elements and the detailed description of such common elements will not be repeated.

Referring now to FIG. 2, a portion of the feed air in conduit 122 connecting primary heat exchanger 214 with bottom reboiler 220 bypasses bottom reboiler 220. Conduit 166 communicates with conduit 122 and a portion of the feed air in conduit 122 passes through conduit 166 and valve 908, and then through conduit 180 into high pressure column 222. Booster compressor 242 is employed to provide further energy to the system. A portion of the feed air is passed in stream 170 to booster compressor 242 wherein it is compressed to a pressure generally within the range of from 100 to 1000 psia. The resulting feed air is passed in stream 172 to cooler 244 wherein it is cooled of the heat of compression, and then from cooler 244 through conduit 174 to primary heat exchanger 214 wherein it is cooled. A portion is withdrawn after partial traverse of primary heat exchanger 214 in stream 400 and passed to turboexpander 216 wherein it is turboexpanded and then passed in stream 401 into low pressure column 226. Another portion of the feed air in stream 174 fully traverses primary heat exchanger 214 and is further cooled and preferably condensed. The resulting feed air is passed out from primary heat exchanger 214 in stream 176 and into high pressure column 222. In the embodiment illustrated in FIG. 2, conduit 176 communicates through valve 912 with conduit 180 for common passage into high pressure column 222.

In the embodiment of the invention illustrated in FIG. 2 the product oxygen is taken from side column 221 as liquid. In this embodiment, conduit means 152 for passing product oxygen from the side column to the primary heat exchanger 214 includes liquid pump 240 which raises the pressure of the product oxygen entering primary heat exchanger 214. The product oxygen is vaporized by passage through primary heat exchanger 214 by virtue of the energy supplied thereto by the operation of booster compressor 242. Elevated pressure product oxygen is recovered from primary heat exchanger 214 in line 154.

In the embodiment of the invention illustrated in FIG. 3, the feed air fed to turboexpander 216 in stream 400 is passed from turboexpander 216 in stream 402 into high pressure column 222. A portion of the nitrogen-enriched vapor in stream 130 is passed in stream 137 through valve 920 and in stream 141 into conduit 122 to form combined stream 145 which is passed into bottom reboiler 220 so as to provide enhanced reboiling of side column 221. Conduit 129 communicates with conduit 128 and serves to pass a portion of the fluid exiting bottom reboiler 220 through valve 916 and into low pressure column 226, while another portion of the fluid exiting bottom reboiler 220 passes through valve 914 and into high pressure column 222. During low purity operation valves 916, 920 and 908 are normally closed while valves 914 and 910 are open. During high purity operation, valves 916, 920 and 908 are open, while valves 914 and 910 are normally closed.

Now with the use of this invention one can efficiently produce either high purity oxygen or low purity oxygen and can easily and quickly switch from the production of one to the other as the need arises. Although the invention has been described in detail with reference to certain preferred embodiments, those skilled in the art will recognize that there are other embodiments of the invention within the spirit and the scope of the claims.

We claim:

1. A cryogenic rectification apparatus for producing high purity oxygen or low purity oxygen comprising:

(A) a double column comprising a high pressure column and a low pressure column;

(B) a side column having a bottom reboiler;

(C) a primary heat exchanger, and a feed line for passing feed air to the primary heat exchanger;

(D) an auxiliary compressor having an input and an output, means for passing feed air from the feed line to the auxiliary compressor input, and means for passing feed air from the auxiliary compressor output to the feed line;

(E) means for passing feed air from the primary heat exchanger to the bottom reboiler, and means for passing feed air from the bottom reboiler to the high pressure column;

(F) means for passing fluid from the low pressure column to the side column;

(G) means for passing product from the side column to the primary heat exchanger; and (H) means for recovering product high purity or low purity oxygen from the primary heat exchanger.

2. The apparatus of claim 1 further comprising a turboexpander, means for passing feed air to the turboexpander, and means for passing feed air from the turboexpander into at least one of the high pressure column and the low pressure column.

3. The apparatus of claim 1 further comprising conduit means communicating with the means for passing feed air from the primary heat exchanger to the bottom reboiler and also communicating with the high pressure column.

4. The apparatus of claim 1 further comprising conduit means communicating with the means for passing feed air from the bottom reboiler to the high pressure column and also communicating with the low pressure column.

5. The apparatus of claim 1 further comprising a booster compressor, means for passing feed air to the booster compressor, and means for passing feed air from the booster compressor to the high pressure column.

6. The apparatus of claim 5 further comprising a turboexpander, means for passing feed air from the booster compressor to the turboexpander, and means for passing feed air from the turboexpander to the low pressure column.

7. The apparatus of claim 5 further comprising a turboexpander, means for passing feed air from the booster compressor to the turboexpander, and means for passing feed air from the turboexpander to the high pressure column.

8. The apparatus of claim 1 further comprising means for passing fluid from the upper portion of the high pressure column to the bottom reboiler.

* * * * *